US005568915A

United States Patent [19]

Raymond

[11] Patent Number: 5,568,915

[45] Date of Patent: Oct. 29, 1996

[54] C-CLAMP WITH ADJUSTABLE THROAT AND A METHOD OF COMPRESSING A WORK PIECE

[76] Inventor: Ronald Raymond, P.O. Box 403, Standish, Mich. 48658

[21] Appl. No.: 302,346

[22] Filed: Sep. 7, 1994

[51] Int. Cl.[6] ..... B25B 1/02

[52] U.S. Cl. ..... 269/147; 269/166

[58] Field of Search ..... 269/147, 148, 269/149, 166, 167, 168, 169, 171, 171.5, 208, 249

[56] References Cited

U.S. PATENT DOCUMENTS

| | | | |
|---|---|---|---|
| 307,439 | 11/1884 | Corbett . | |
| 319,517 | 6/1885 | Sheldon . | |
| 404,368 | 5/1889 | Stearns . | |
| 655,193 | 8/1900 | Carlson | 269/166 |
| 775,659 | 11/1904 | Jorgensen . | |
| 881,530 | 3/1908 | Barker . | |
| 932,516 | 8/1909 | Todd . | |
| 1,452,164 | 4/1923 | Margelis . | |
| 2,656,864 | 10/1953 | Hopfeld | 269/167 |
| 4,143,869 | 3/1979 | Paterson et al. | 269/166 |

*Primary Examiner*—Robert C. Watson
*Assistant Examiner*—Thomas W. Lynch
*Attorney, Agent, or Firm*—Learman & McCulloch

[57] ABSTRACT

The C-clamp (10) has an elongated structural member (12) and two clamp heads (14). Each clamp head (14) has a body (16) with an elongated structural member passage (22) having a central axis (24) and a jaw (18) connected to the body (16) by a screw (20). The passage (22) is defined by side plates (26 and 28), an upper friction block (30) and a lower friction block (32). The friction blocks (30 and 32) are axially spaced apart along the central axis (24). Contact surfaces (34 and 40) on the friction blocks (30 and 32) are spaced apart in a direction normal to the central axis (24) a distance less than the height of the structural member (12).

15 Claims, 3 Drawing Sheets

FIG-1
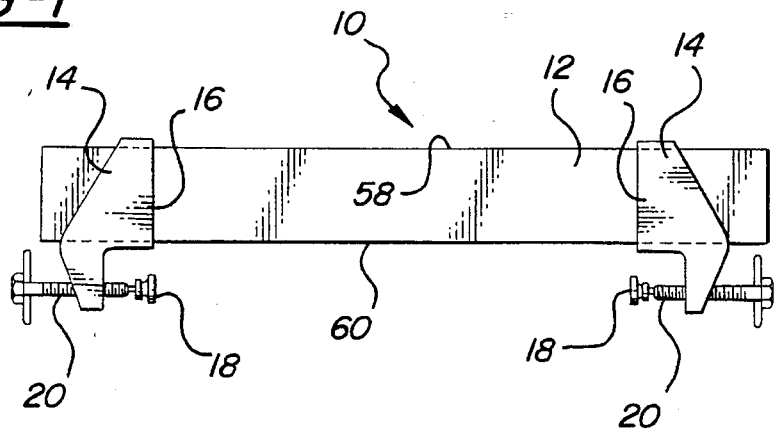
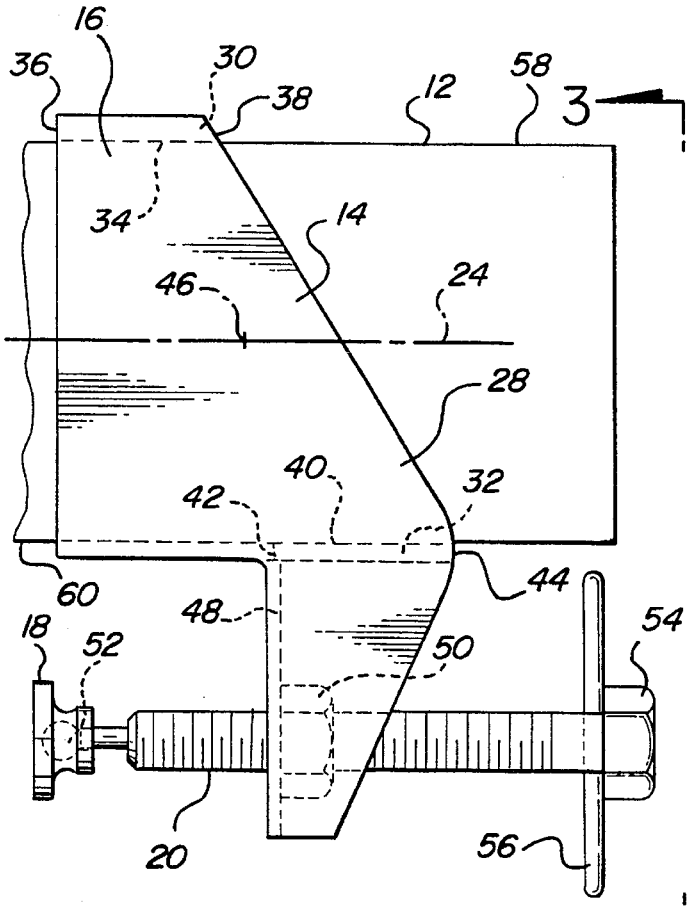
FIG-2
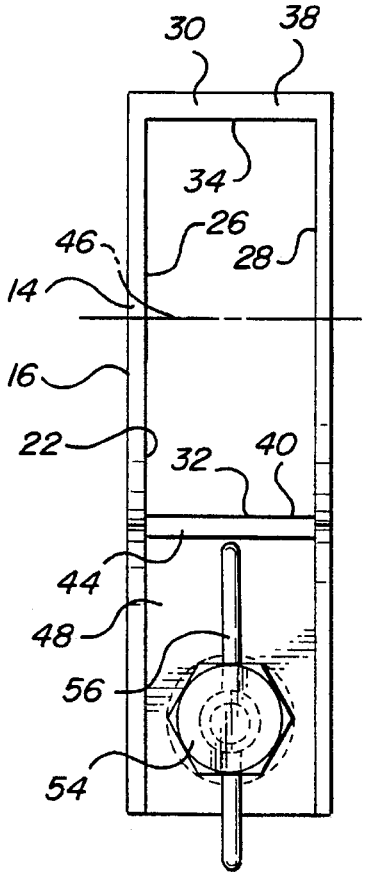
FIG-3

C-CLAMP WITH ADJUSTABLE THROAT AND A METHOD OF COMPRESSING A WORK PIECE

TECHNICAL FIELD

This invention is in a C-clamp and, more particularly, in a C-clamp with an elongated structural member and a pair of clamp heads that are held in selected positions along the length of the elongated structural member by friction.

BACKGROUND OF THE INVENTION

C-clamps with a long bar and two clamp heads have been used for many years. The C-clamps have at least one clamp head that is moveable to a plurality of positions along the length of a bar and a fixed clamp head in some C-clamp designs. Both clamp heads are moveable along the length of a long bar in other C-clamp designs.

The majority of the C-clamps with a long bar have employed mechanical locks to lock clamp heads relative to the long bar. The mechanical locks generally require a special, dedicated long bar. These special, dedicated long bars may have slots, apertures, grooves, or other structures to position a clamping head. Dedicated long bar members are relatively expensive and are difficult to transport and store, due to their length.

A few C-clamps with bars and clamp heads have special clamps or wedge members for holding a clamp head in a selected position along the length of a long bar. Special clamps for holding a clamp head are expensive, subject to failures and frequently permit slippage. Some wedge-type retainers have moving parts and may even have springs. The moving parts are prone to breakage. The wedges are also prone to locking up and being very difficult to release.

A few clamp heads used with long bars to produce a C-clamp with an adjustable throat produce high stress concentrations between clamp heads and long bars. Such stress concentrations can damage long bars. A damaged long bar must be replaced at substantial expense. Some clamp heads with high stress concentrations are used only with special, long bars made from hardened steel. Such long bars are expensive and may allow clamp heads to slip.

SUMMARY OF THE INVENTION

An object of the invention is to provide a C-clamp with two clamp heads that can be placed and held in any position on a standard, elongated structural member that is readily available. Another object of the invention is to provide clamp heads which are held in place on an elongated structural member by friction. A further object of the invention is to provide clamp heads which minimize damage to an elongated structural member upon which they are mounted. A still further object of the invention is to provide a C-clamp which is easy to adjust.

The C-clamp with an adjustable throat, of this invention, includes two clamp heads and one elongated structural member. The elongated structural member can be a standard wood 2×4, 2×6, 4×4 or any other desired size structural member. The wood member does not have to be oak or any other expensive hardwood. The structural member can also be a metal pipe, angle, I-beam, channel member, tubular member, or other shape.

The clamp head used on the elongated structural member includes a body with an elongated structural member passage, and a jaw attached to the body by a screw at one side of the structural member passage. The passage has a central axis. The jaw is advanced by the screw along a path parallel to the central axis. The elongated structural member passage is defined by a pair of side plates, an upper friction block and a lower friction block. The two friction blocks have structural member contact surfaces that are axially spaced apart along the passage central axis. At least one of the two friction blocks is shaped to conform to the shape of the elongated structural member that is employed. The surface area on each of the friction blocks that contacts the elongated structural member is sufficiently large to minimize surface damage to the member. If the elongated structural member is soft wood, the contact surface area on each friction member may be fairly large.

The application of a clamping force, on a work piece with one or more articles that are to be compressed, stresses the elongated structural member and the clamp heads. It is desirable for the parts of the clamp to be in their most efficient alignment when they are stressed. To attain the desired alignment, the upper and lower friction blocks are spaced apart in a direction normal to the central axis less than the unloaded space required for the elongated structural member. If the structural member is soft wood, the friction blocks are significantly closer together than the unstressed dimension of the wood member. If the structural member is a steel shaft, the friction blocks are slightly closer together than the diameter of the shaft.

The foregoing and other objects, features, and advantages of the present invention will become apparent in the light of the following detailed description of an exemplary embodiment thereof, as illustrated in the accompanying drawings.

BRIEF DESCRIPTION OF THE DRAWINGS

FIG. 1 is a side elevational view of the C-clamp;

FIG. 2 is an enlarged side elevational view of one clamp head and a portion of a rectangular, elongated structural member;

FIG. 3 is an end view of the clamp head shown in FIG. 2;

DETAILED DESCRIPTION OF THE PREFERRED EMBODIMENTS

Figure 4:
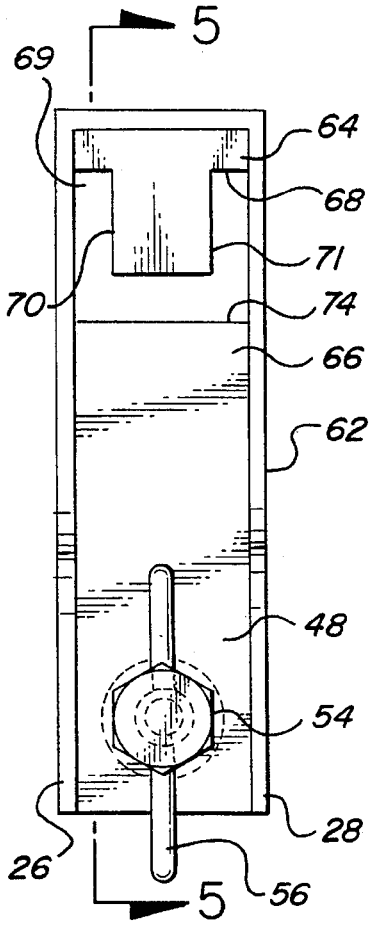
FIG. 4 is an enlarged end view of a clamp head that employs an angle member for an elongated structural member.

The C-clamp, generally designated 10, as shown in FIG. 1 has an elongated structural member 12 and two clamp heads 14. Each clamp head includes a body 16 and a jaw 18 connected to the body 16 by a screw 20. The clamp heads 14 can be moved to any position along the length of the structural member 12 to adjust the throat between the jaws 18. A work piece including one or more articles which are to be compressed is positioned between the jaws 18 of two clamp heads 14. One of the jaws 18 is advanced by the screw 20 to compress the work piece. If desired, both jaws 18 can be advanced to compress a work piece. In some cases, it may be necessary to advance both jaws 18 to obtain the desired compression if the work piece is resilient. If the workpiece to be compressed has limited resilience, it may be possible to have a jaw 18 on one clamp head 14 that is fixed relative to the body 16. A fixed jaw 18 eliminates the cost of a screw 20.

The clamp heads 14 can be rotated 180° relative to the elongated structural member 12, from the positions shown in FIG. 1. Advancing one of the jaws 18 with the screw 20 would then separate one object from another. A clamp head 14 and the structural member 12 would form a jack.

The clamp heads 14 used with one elongated structural member 12 are preferably identical to each other, although it is possible to employ a fixed jaw 18 on one of the clamp heads as stated above. Only one clamp head for use with a specific structural member 12 will be described below.

The clamp head 14 shown in FIGS. 1, 2, and 3 is for use with an elongated structural member 12 that has a rectangular cross section. This rectangular structural member 12 can be wood, plastic, metal, or other suitable material. A wood structural member 12 would be solid, while a metal member could be a tube. Tubes reduce weight where the material provides sufficient strength without being a solid.

The clamp head 14 as shown in FIG. 2 has a body 16 with an elongated structural member passage 22. The passage 22 has a central axis 24. The passage 22 is defined by side plates 26 and 28, an upper friction block 30 and a lower friction block 32. The upper friction block 30 is preferably integral with the side plates 26 and 28 and the lower friction block 32 is welded to the side plates. The upper friction block 30 has a contact surface 34 that contacts the structural member 12, extends from the side plate 26 to the side plate 28 and from a front edge 36 to a rear edge 38. The lower friction block 32 has a contact surface 40 that contacts the structural member 12, extends from the side plate 26 to the side plate 28 and from a front edge 42 to a rear edge 44. The contact surface 34 is in a horizontal plane that is preferably parallel to the central axis 24 and to a horizontal plane containing the contact surface 40. The rear edge 38 of the upper friction block 30 is spaced from the front edge 42 of the lower friction block 32 in a direction parallel to the central axis 24. The spacing in a direction parallel to the central axis 24, between the rear edge 38 and the front edge 42 provides a diagonal distance between the upper friction block 30 and the lower friction block 32 that exceeds the height of the structural member 12. Rotating the body 16 clockwise about a transverse axis 46, as seen in FIG. 2, moves the upper and lower friction blocks 30 and 32 out of contact with the structural member 12 and frees the clamp head 14 to be repositioned along the length of the structural member. If the space between the rear edge 38 and the front edge 42, in a direction parallel to the central axis 24 is too large, the clamp heads 14 will slide on the structural member 12. The upper and lower friction blocks 30 and 32 must exert forces on the structural member 12 that act through moment arms that are shorter than the moment arm through which a force on the jaw 18 acts.

A cross plate 48 is integral with the side plates 26 and 28 below the elongated structural member passage 22. A nut 50 with internal threads is attached to the cross plate 48. A screw 20 screws into the nut 50 and passes through the cross plate 48. A jaw 18 is attached to one end of the screw 20 by a ball 52. The other end of the screw 20 has an integral hexagon head 54 and a bar 56 fixed in a bore through the screw 20. The bar 56 serves as a handle for manually rotating the screw 20. The screw 20 can also be rotated by a socket and ratchet handle that engage the hexagon head 54. Rotation of the screw 20 in one direction will advance the jaw 18 away from the cross plate 48 along a path parallel to the central axis 24. Rotation of the screw 20 in the opposite direction will retract the jaw 18 toward the cross plate 48.

Advancing the jaw 18 into contact with a workpiece positioned between two jaws 18 will tend to rotate the clamp head 14, as shown in FIG. 2, counterclockwise about the transverse axis 46 and force the upper friction block 30 and the lower friction block 32 into contact with the elongated structural member 12. The force on the jaw 18 acts through a longer moment arm to apply a torque about the transverse axis 46 than the moment arms of the upper friction block 30 and the lower friction block 32. As a result, the force normal to the contact surface 34 and the contact surface 40 exceeds the force on the jaw 18 sufficiently to prevent sliding of the contact surfaces relative to the structural member 12. The contact surfaces 34 and 40 can be roughened or provided with small teeth to further insure that the clamp head does not slide on the structural member 12.

The elongated structural member 12 can be made from wood 2×4s, 2×6s, 4×4s, 6×6s, or any other size member that is selected. The upper and lower friction blocks 30 and 32 tend to compress the wood and become imbedded. To limit damage to the structural member 12, the distance between horizontal planes that include the contact surfaces 34 and 40 should be less than the height of the structural member 12. Ideally, when the jaw 18 is loaded by workpiece to a substantial percentage of the maximum expected load, the screw 20 should be exerting a force on the jaw 18 in a direction parallel to the upper and lower surfaces 58 and 60 of the structural member 12. With some 2×4s employed as structural member 12, the space between the upper and lower friction blocks 30 and 32 should be at least ⅛th of an inch less than the actual height of the nominal 4 inch height. The same principles apply with metal elongated structural members 12, but the difference between the space between the upper and lower friction blocks 30 and 32 and the height of the structural member is generally much less than the difference required with wood structural members.

Figure 5:
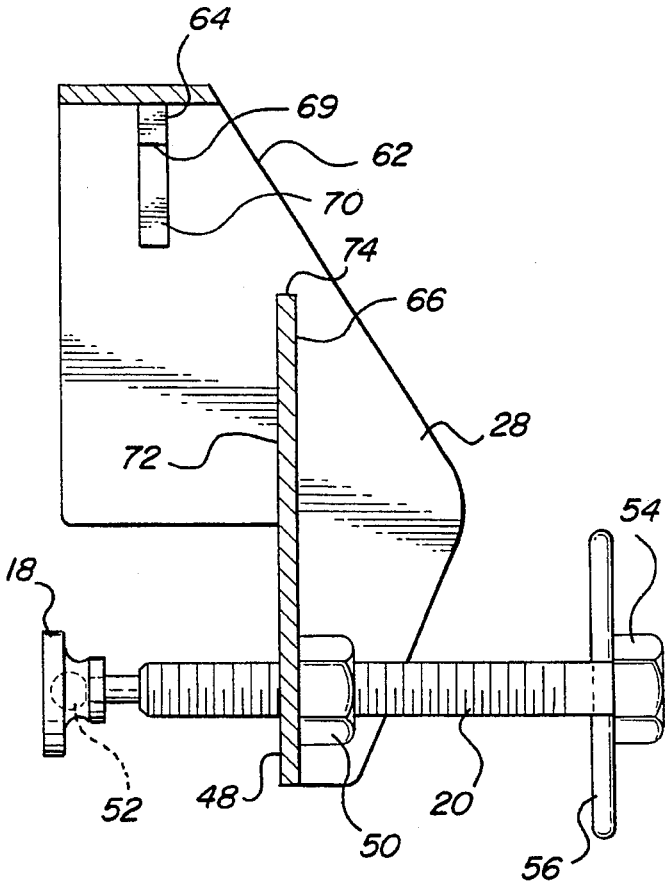
FIG. 5 is a sectional view taken along line 5—5 in FIG. 4.

A clamp head 62 is shown in FIGS. 4 and 5 that is designed to be used with an L-shaped or angle structural member. Clamp head 62 is identical to the clamp head 14 described above except for the upper friction block 64 and the lower friction block 6. The same reference numbers have been used in FIGS. 4 and 5 as used in FIGS. 1, 2 and 3 for parts that are identical. The upper friction block 64 has a horizontal downwardly facing contact surfaces 68 and 69, a surface 70 parallel to and spaced from the side plate 26 and a surface 71 parallel to and spaced from the side plate 28. The lower friction block 66 has a front surface 72 that has been moved forward to reduce the distance between the upper and lower friction blocks 64 and 66. The lower friction block 66 has a contact surface 74. The area of the contact surface 74 on the lower friction block 66 has been reduced. Metal structural members require less surface area than wood members. A U-shaped passage is formed between the upper and lower friction blocks 64 and 66 for the passage of an L-shaped angular structural member, as shown in FIG. 4. The U-shaped passage can accept an angle member with a vertical flange on either the right or the left.

Figure 6:
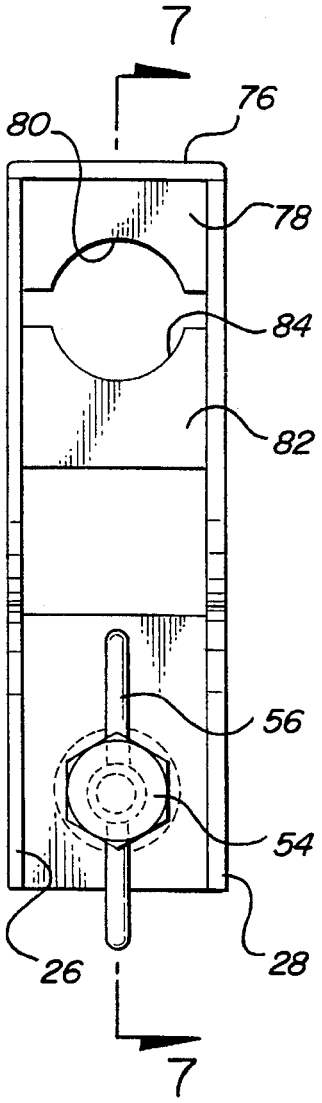
FIG. 6 is an enlarged end view of a clamp head that employs a round rod or a pipe for an elongated structural member.
Figure 7:
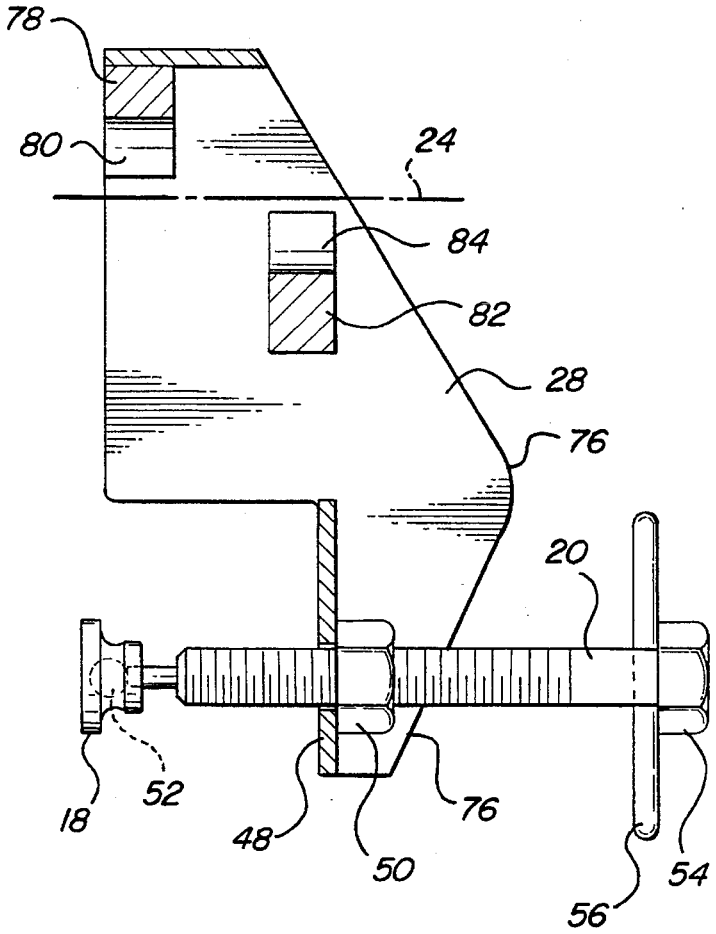
FIG. 7 is a sectional view taken along line 7—7 in FIG. 6.

A clamp head 76 is shown in FIGS. 6 and 7. The clamp head is designed for use with a round structural member 12. The structural member could be a pipe or a solid rod with a circular cross section. The clamp head 76 has an upper friction block 78 with an arcuate contact surface 80 and a lower friction block 82 with an arcuate contact surface 84. The arcuate contact surfaces 80 and 84 are arcs with a substantially constant radius about axes that are parallel to a central axis 24 of the passage for an elongated structural member 12. The radius of the arcs is preferably equal to or slightly larger than the Outside radius of the round structural member. The maximum distance between the surfaces 80 and 84 is a little less than the outside diameter of the round structural member. If desired, the upper friction block 78 and the lower friction block 82 can be attached to the side plates 26 and 28 by removable fasteners. The removable fasteners would allow the exchange of the upper and lower friction blocks 78 and 82 for friction blocks that accommodate round, elongated structural members with different outside diameters.

Upper and lower friction blocks can be fabricated to accommodate I-beams, channels and structural members with other shapes. If desired, such friction blocks could be interchangeable with the friction blocks shown in the drawing.

The linear actuator for advancing and retracting the jaw 18 of a clamp head 14 is a screw 20 as described above. The screw 20 could be replaced by a fluid actuated cylinder, a mechanical linear actuator, a cam actuator or some other type of actuator capable of advancing the jaw 18.

Preferred embodiments of the invention have been described in detail, but are examples only and the invention is not restricted thereto. It will be easily understood by those skilled in the art that modifications and variations can easily be made within the scope of this invention.

I claim:

1. A clamp head comprising a clamp head body with two spaced-apart side plates, an upper friction block secured to both side plates and a lower friction block secured to both side plates and wherein the two side plates the upper friction block and the lower friction block cooperate to define an elongated structural member passage with a central axis and wherein the lower friction block is axially spaced from the upper friction block along the central axis, a linear actuator supported by the clamp head body to one side of the elongated structural member passage, a first jaw connected to the linear actuator and moveable along a path generally parallel to the central axis, an elongated structural member contact area on the upper friction block having a friction surface that extends in a direction generally parallel to said central axis, and an elongated structural member contact area on the lower friction block that extends in a direction generally parallel to said central axis.

2. A clamp head as set forth in claim 1, wherein the linear actuator is a screw.

3. A clamp head as set forth in claim 1, wherein a force exerted on the first jaw in a direction parallel to the central axis tends to rotate the clamp head body about a transverse axis perpendicular to the central axis.

4. A clamp head as set forth in claim 1, wherein the upper friction block elongated structural member contact area is a flat surface and the lower friction block elongated structural member contact area is a flat surface.

5. A clamp head as set forth in claim 4 wherein said elongated structural member contact area on the upper friction block is generally parallel to said elongated structural member contact area on the lower friction block.

6. A clamp head as set forth in claim 1 wherein the upper friction block elongated structural member contact area is an arcuate surface and wherein the lower friction block elongated structural member contact area is an arcuate surface.

7. A clamp head as set forth in claim 6 wherein the arcuate surface on the upper friction block has a constant radius and the arcuate surface on the lower friction block has a constant radius.

8. A clamp head as set forth in claim 1 wherein the maximum distance between said elongated structural member contact area on the upper friction block and said elongated structural member contact area on the lower friction block in a direction perpendicular to said central axis is not more than the maximum distance between an upper friction block contact surface and a lower friction block contact surface on an elongated structural member in a direction perpendicular to a long axis of said elongated structural member.

9. A C-clamp with an adjustable throat comprising an elongated structural member with a long axis extending the length of said elongated structural member; a first clamp head with a clamp head body, an elongated structural member passage which receives said elongated structural member, an upper friction block with an elongated structural member contact area defining a portion of said passage, extending in a direction generally parallel to said long axis and in contact with a first upper area of said elongated structural member, a lower friction block with an elongated structural member contact area defining a portion of said passage, extending in a direction generally parallel to said long axis and in contact with a first lower area of said elongated structural member that is spaced from said first upper area along the length of said elongated structural member, and a first jaw attached to the clamp head body by a linear actuator operable to advance the first jaw along a line generally parallel to the long axis of said elongated structural member; and a second clamp head with a clamp head body, an elongated structural member passage which receives said elongated structural member, an upper friction block with an elongated structural member contact area defining a portion of said passage, extending in a direction generally parallel to said long axis and in contact with a second upper area of said elongated structural member, a lower friction block with an elongated structural member contact area defining a portion of said passage, extending in a direction generally parallel to said long axis and in contact with a second lower area of said elongated structural member that is spaced from said second upper area along the length of said elongated structural member, and a second jaw attached to the clamp head body by a linear actuator operable to advance the second jaw along a line generally parallel to the long axis of said elongated structural member.

10. A C-clamp as set forth in claim 9 wherein the elongated structural member is wood and has a predetermined height and width.

11. A C-clamp as set forth in claim 10 wherein the elongated structural member contact areas of the upper friction block and the lower friction block of the first clamp head are friction surfaces that are generally parallel to each other and that are in planes spaced apart a distance less than the predetermined height of the elongated structural member; and the elongated structural member contact areas of the upper friction block and the lower friction block of the second clamp head are friction surfaces that are generally parallel to each other and that are in planes spaced apart a distance less than the predetermined height of the elongated structural member.

12. A C-clamp as set forth in claim 9 wherein the elongated structural member is a metal shaft with a circular cross section.

13. A C-clamp as set forth in claim 12 wherein the upper friction block and the lower friction block elongated structural member contact areas of the first clamp head are arcuate surfaces that are arcs about axes parallel to a central axis of the elongated structural member passage through the first clamp head, and the upper friction block and the lower friction block elongated structural member contact areas of the second clamp head have arcuate surfaces that are arcs about axes parallel to a central axis of the elongated structural member passage through the second clamp head.

14. A C-clamp as set forth in claim 9 wherein the elongated structural member is a structural metal member with a uniform cross sectional shape.

15. A C-clamp as set forth in claim 14 wherein the upper friction blocks of the first and second clamp heads are shaped to accommodate the passage of the elongated structural member in the elongated structural member passage and to orient the change heads to a selected position relative to the long axis of said elongated structural member and the lower friction blocks of the first and second clamp heads each have a friction surface that contacts a lower surface of the elongated structural member.

* * * * *

UNITED STATES PATENT AND TRADEMARK OFFICE

CERTIFICATE OF CORRECTION

PATENT NO. : 5,568,915
DATED : October 29, 1996
INVENTOR(S) : Ronald Raymond

It is certified that error appears in the above-indentified patent and that said Letters Patent is hereby corrected as shown below:

Column 8, line 3, change "change" to -- clamp --.

Signed and Sealed this

Seventh Day of January, 1997

Bruce Lehman

*Attest:*

BRUCE LEHMAN

*Attesting Officer*

*Commissioner of Patents and Trademarks*